US011067104B1

(12) United States Patent
Goslovich et al.

(10) Patent No.: US 11,067,104 B1
(45) Date of Patent: Jul. 20, 2021

(54) INTEGRATED CYLINDER PISTON AND BEARING AS A HYDRAULIC CUSHION

(71) Applicant: Caterpillar Inc., Peoria, IL (US)

(72) Inventors: Kurt S Goslovich, Naperville, IL (US); Thomas K. Yeung, Bolingbrook, IL (US); Ananda S. Ponnusamy, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/098,775

(22) Filed: Nov. 16, 2020

(51) Int. Cl.
*F15B 15/22* (2006.01)
*F15B 15/14* (2006.01)
*F04B 53/14* (2006.01)

(52) U.S. Cl.
CPC ..... *F15B 15/223* (2013.01); *F04B 53/143* (2013.01); *F15B 15/1452* (2013.01); *F15B 15/226* (2013.01)

(58) Field of Classification Search
CPC .. F15B 15/1452; F15B 15/222; F15B 15/223; F15B 15/226; F16J 1/02; F16J 1/09
See application file for complete search history.

(56) References Cited

U.S. PATENT DOCUMENTS 2,984,529 A 5/1961 Dailey
3,382,772 A * 5/1968 Kampert ..... F16J 10/02 92/84
3,704,650 A * 12/1972 Berg ..... E02F 9/2203 91/395
3,802,319 A * 4/1974 Bridwell ..... F15B 15/224 91/409
4,651,623 A 3/1987 Rogers
5,207,145 A * 5/1993 Kemner ..... F15B 15/223 91/405
6,382,075 B1 * 5/2002 Chiaramonte ..... B62D 5/061 91/399
6,397,725 B1 * 6/2002 Guy ..... F15B 15/222 91/394
9,388,902 B2 * 7/2016 Sueyoshi ..... F15B 15/1452
10,131,006 B2 * 11/2018 Hung ..... B23D 51/18
2003/0140781 A1 * 7/2003 Weiss ..... F15B 15/223 92/85 B
2009/0084257 A1 * 4/2009 Buckley ..... F15B 15/224 91/403
2016/0273559 A1 * 9/2016 Takai ..... F15B 15/14

FOREIGN PATENT DOCUMENTS

CN 103518069 1/2014
EP 1435461 7/2004
JP 5789456 9/2011

* cited by examiner

*Primary Examiner* — Michael Leslie
(74) *Attorney, Agent, or Firm* — Schwegman, Lundberg & Woessner

(57) ABSTRACT

An integrated piston and bearing may include a piston having an outer peripheral surface and a first end and a second end and a bearing arranged on the outer peripheral surface. The bearing may include a surface contour including a setback region with a first thickness and a full region with a second thickness, thicker than the first thickness. The bearing may also include a snubbing chamfer transitioning between the first and second thicknesses.

18 Claims, 6 Drawing Sheets

INTEGRATED CYLINDER PISTON AND BEARING AS A HYDRAULIC CUSHION

TECHNICAL FIELD

The present application relates generally to hydraulic cylinders such as those used on work machines including heavy equipment for construction, farm implements, and other machines adapted for performing work. More particularly, the present application relates to an integrated piston and bearing. Still more particularly, the present application relates to a particularly shaped piston and bearing that is arranged with respect to one or more ports in a hydraulic cylinder to perform hydraulic cushioning.

BACKGROUND

Hydraulic systems are a common feature of work machines, such as skid steer loaders, wheel loaders, excavators, back hoes, bull dozers, and other heavy equipment. The hydraulic systems may operate to provide powerful, actuated, and controlled motion of particular elements of the work machine. For example, in the case of a skid steer, hydraulic systems may be used to raise and lower arms that support a bucket, fork, or other tool in the front of the work machine. Another hydraulic system may be used to control the tool to tip the bucket, fork, or other tool up or down, for example.

Hydraulic systems commonly include a hydraulic fluid reservoir, a hydraulic pump, a hydraulic line, and a hydraulic cylinder. In operation, the pump may pump fluid from the reservoir, through the line, and into the cylinder to cause a cylinder rod to extend. That is the hydraulic cylinder may include a cylinder housing, a piston that is moveable through a length of the housing, and a piston rod secured to the piston and extending out of one end of the housing. Fluid flow into the housing may cause the piston to translate through the housing and force the rod out the end of the housing.

In some circumstances, controlled motion may be desired as the piston approaches each end of the cylinder housing such that the piston is not subject to abrupt stoppage of motion and/or to avoid damage to the system. This controlled motion may be referred to as snubbing and may be provided by a cushioning system or mechanism.

In many circumstances, snubbing systems may be positioned and arranged such that they take up space along the axial direction of the cylinder. One example of a cushioning, or snubbing, system is shown in Chinese Patent Application 103518069 entitled Cushion Mechanism for Hydraulic Cylinder.

SUMMARY

In one or more embodiments, an integrated piston and bearing may include a piston having an outer peripheral surface and a first end and a second end. The integrated piston and bearing may also include a bearing arranged on the outer peripheral surface and having a surface contour including a setback region with a first thickness and a full region with a second thickness, thicker than the first thickness. The bearing may also include a snubbing chamfer transitioning between the first and second thicknesses.

In one or more embodiments, a hydraulic cylinder may include a cylinder housing and an integrated piston and bearing arranged within the housing. The integrated piston and bearing may have a length, a stroke length defined by the housing, and an outer surface contour including a snubbing feature. The hydraulic cylinder may also include a piston rod extending from the integrated piston and bearing and out an end of the cylinder housing. The hydraulic cylinder may also include a port arranged on the housing within a region defined by the length of the integrated piston and bearing and the stroke length such that a portion of the integrated piston and bearing passes by the port when the integrated piston and bearing is at an end of the stroke length.

In one or more embodiments, a work machine may include a body supported by a ground engaging transport mechanism and a hydraulically driven tool comprising a hydraulic cylinder. The hydraulic cylinder may include a cylinder housing and an integrated piston and bearing arranged within the housing. The integrated piston and bearing may have a length, a stroke length defined by the housing, and an outer surface contour including a snubbing feature. The hydraulic cylinder may also include a piston rod extending from the integrated piston and bearing and out an end of the cylinder housing. The hydraulic cylinder may also include a port arranged on the housing within a region defined by the length of the integrated piston and bearing and the stroke length such that a portion of the integrated piston and bearing passes by the port when the integrated piston and bearing is at an end of the stroke length.

In one or more embodiments, a method of operation may include actuating a hydraulic system to extend or retract a hydraulic cylinder. The method may also include gradually transitioning from restricting fluid flow to/from a port on the cylinder to restricting an area of the port so as to cushion the piston as it approaches an end of its stroke length. The method may also include gradually obstructing a larger area of the port.

DETAILED DESCRIPTION

Figure 1:
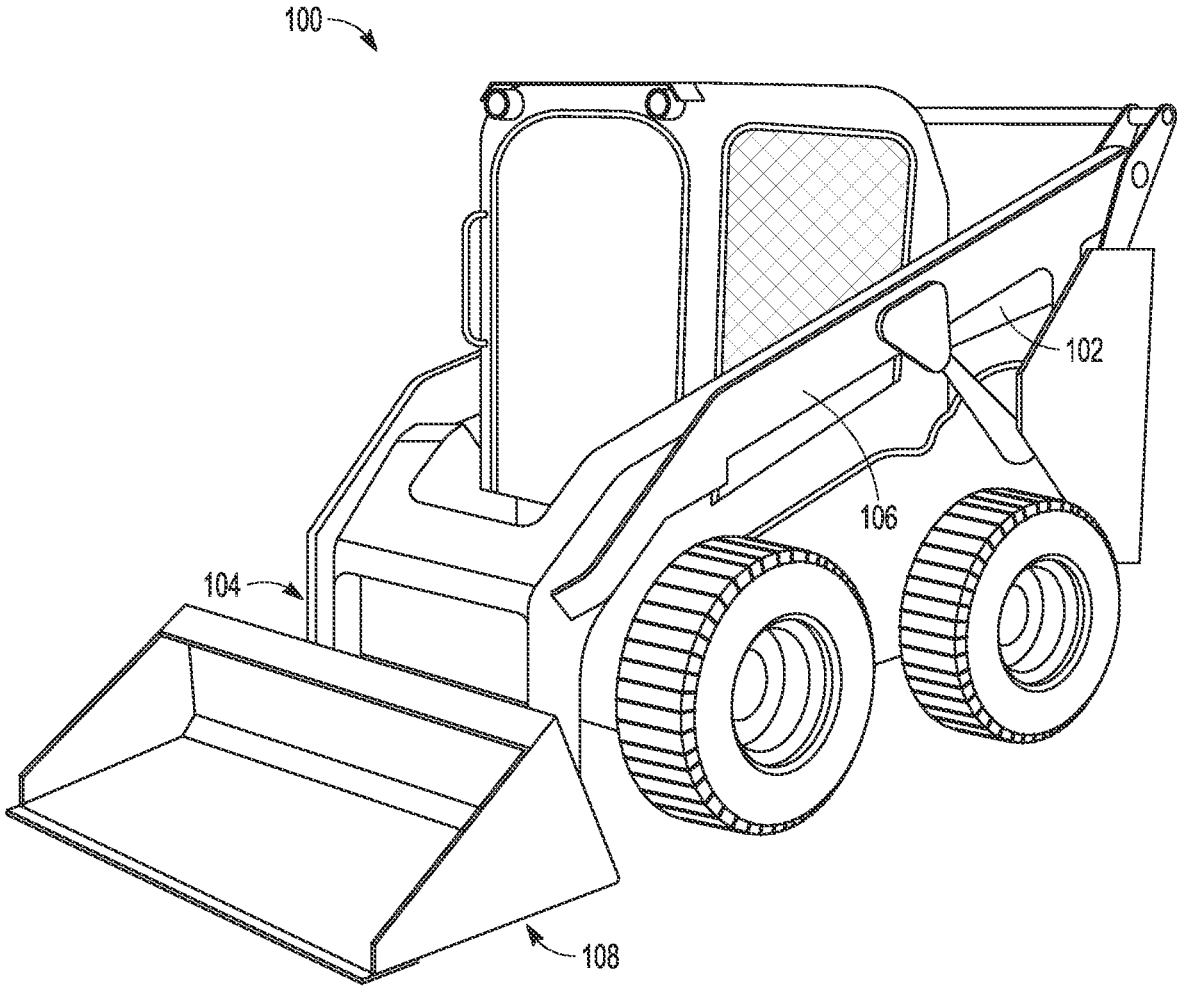
FIG. 1 is a perspective view of a work machine having hydraulic cylinders with an integrated piston and bearing, according to one or more embodiments.

FIG. 1 is a perspective view of a work machine 100 having one or more hydraulic systems. As shown, for example, the work machine 100 may be a skid steer loader and may include a lifting hydraulic system 102 and a tilting hydraulic system 104. For example, the lifting hydraulic system 102 may be adapted to control the position of the lift arms 106 being pivoted about a pivot point. Similarly, the tilting hydraulic system 104 may be adapted to control the position of the bucket 108 being pivoted about a pivot point on the lift arms 106. The hydraulic systems may include a shared or dedicated hydraulic reservoir, a hydraulic pump, a hydraulic line and a hydraulic cylinder and a control system for controlling the pump, one or more valves, or all of these items. In one or more embodiments, the hydraulic cylinders of the systems may include an integrated cylinder piston and bearing that may be particularly adapted to provide hydraulic cushioning. The details of the integrated cylinder piston and bearing are discussed in more detail below.

Figure 2:
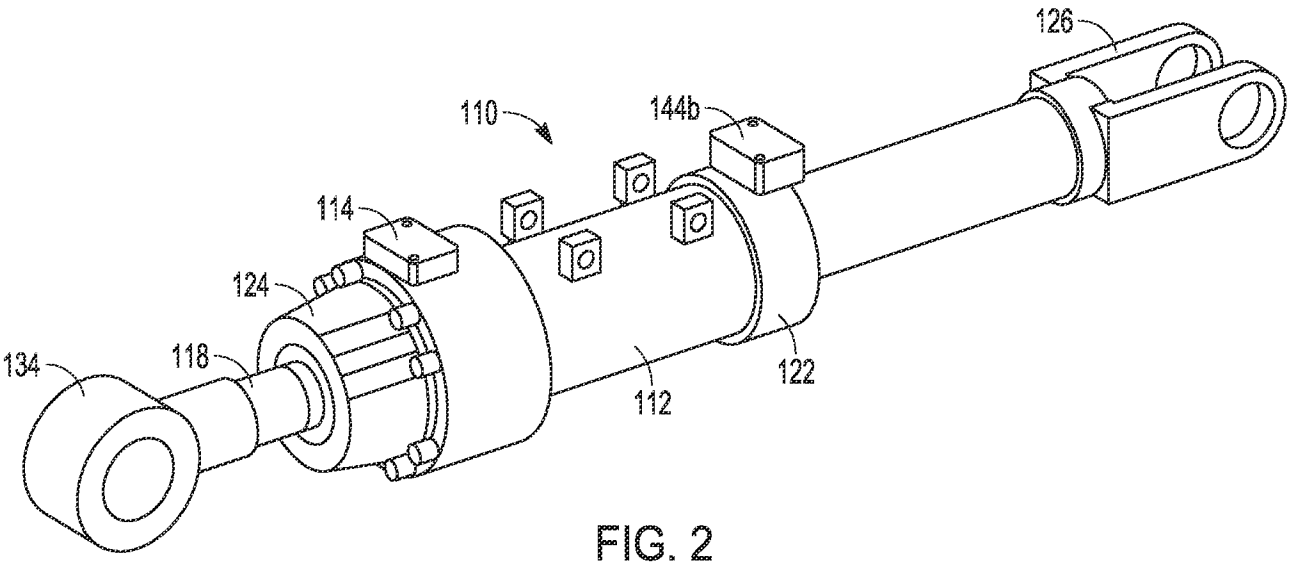
FIG. 2 is a perspective view of a hydraulic cylinder of the work machine of FIG. 1, according to one or more embodiments.
Figure 3:
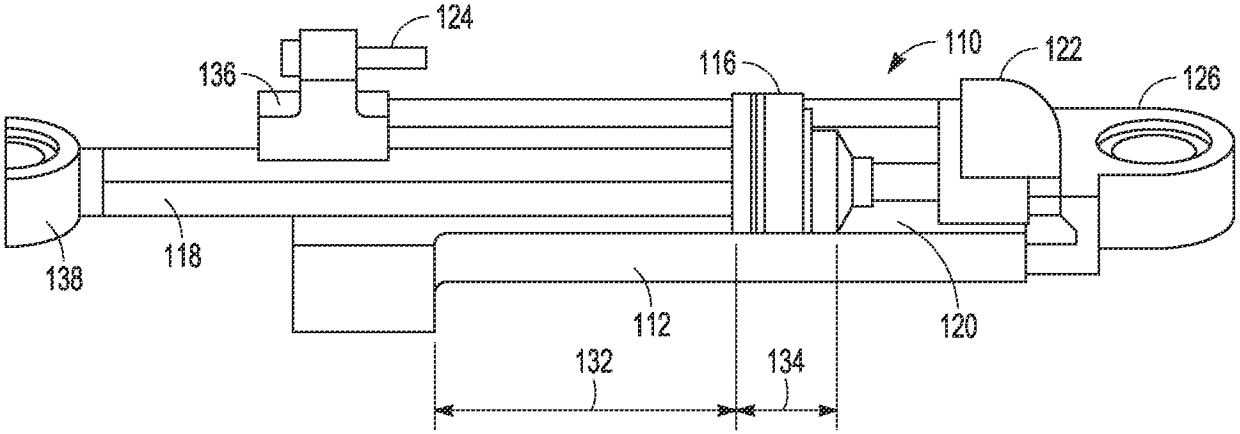
FIG. 3 is a perspective breakaway view of the hydraulic cylinder of FIG. 2, according to one or more embodiments.

FIG. 2 is a perspective view of a hydraulic cylinder 110 shown in isolation from an overall hydraulic system and FIG. 3 is a perspective breakaway view of the hydraulic cylinder 110 revealing its internal components. As shown, in one or both of FIGS. 2 and 3, the hydraulic cylinder may include a cylinder housing 112, one or more ports 114A/B arranged thereon, a piston 116, and a rod 118.

The cylinder housing 112 may be configured to contain fluid pressures and define a piston stroke by guiding the motion of the piston under the fluid pressures. The cylinder housing 112 may include an elongated shell having a cylinder wall defining a cylinder chamber 120. The cylinder wall may define a substantially constant cross-section for the cylinder chamber such that the piston may propagate along and through the cylinder chamber in a smooth reciprocating fashion. In one or more embodiments, the cylinder wall may define a cylinder chamber 120 with a round cross-section. The round cross-section may be advantageous in allowing the cylinder wall to develop substantially uniform hoop stresses as it works to contain the fluid pressures. Still other cross-sections such as square, rectangular, triangular, or other shapes may be used and connection details may be provided at the joints of the shapes to manage the internal pressures.

The cylinder housing 112 may have aback end 122 and an extension end 124 and may include a lug 126 for securing the cylinder. The back end 122 may be an end of the cylinder housing 112 that is substantially closed with respect to the rod 118 and may also be the end that is approached by the piston 116 when the rod 118 is in a retracted position. In contrast, the extension end 124 may be an end of the cylinder housing 112 that provides a sealed opening for the rod to extend through. This end may, thus, be the end of the cylinder housing 112 that is approached by the piston 116 when the rod is an extended position. It is to be appreciated that some cylinders may have rods extending from both ends of the cylinder housing and, as such, in some circumstances both the back end and the extension end may provide a sealed opening for the rod to extend through. For purposes of the present discussion, a closed back end cylinder will be used. The lug 126 for securing the cylinder may be arranged on the back end 122 of the cylinder and may include a local attachment lug (as shown in FIG. 3) or an extended attachment lug (as shown in FIG. 2) may be provided. In either case, the attachment lug 126 may include a substantially round bore extending therethrough for receiving a bolt, pin, or other pivot-providing connection.

The cylinder housing 112 may also include one or more openings 128 for receiving and expelling hydraulic fluid to actuate the piston within the cylinder. The opening is shown in the close-up view of FIG. 4. In one or more embodiments, the cylinder housing 112 may include a back end opening and an extension end opening. The back end opening may be arranged on the back end 122 of the cylinder or it may be arranged through the sidewall in relatively close proximity to the back end of the cylinder. The extension end opening may be arranged on the extension end 124 of the cylinder or it may be arranged through the sidewall in relatively close proximity to the extension end of the cylinder. The two openings 128 may work in concert to actuate the piston. For example, when fluid is entering the back end opening to drive the piston in an extension direction, fluid may be exiting the extension end opening to provide room for the piston to travel in the extension direction. The opposite may be true when the piston is being retracted. The openings in the cylinder may be part and parcel with ports 114A/B on each end of the cylinder.

Figure 4:
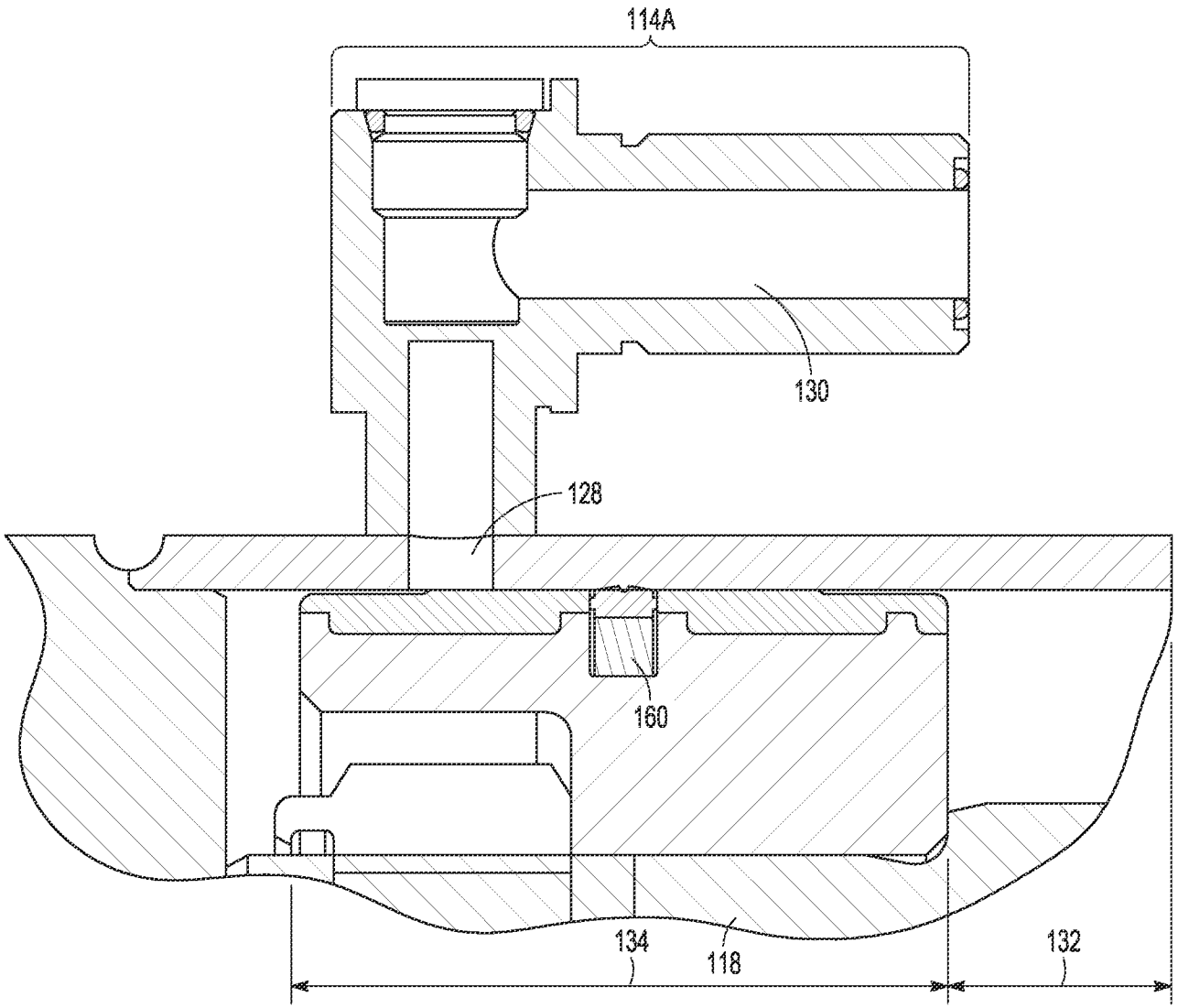
FIG. 4 is a cross-sectional view of a lower port portion of the hydraulic cylinder of FIG. 3, according to one or more embodiments.

With reference to FIG. 4, the ports 114A/B may be configured for routing and/or controlling the flow of fluid into and out of the cylinder via the back end and extension end openings 128 of the cylinder housing 112. The ports may include fixtures 130 arranged over the openings and in fluid communication with the openings 128. The fixtures 130 may be configured for securing to the housing 112 at the opening locations and for securing to hydraulic lines. As such, the hydraulic fluid may flow from the line, through the fixture 130 and through the opening 128 or the hydraulic fluid may flow in the opposite direction. In one or more embodiments, the fixtures 130 may include valves for controlling the flow of fluid into and out of the housing. As shown in FIG. 4, the ports may be arranged along the cylinder in a manner that provide for some portion of the piston 116 to pass by the port 114A. That is, the piston 116 may have a stroke length 132 within the cylinder chamber 120. The piston 116 may also have a length 134 measured along the stroke length. In one or more embodiments, the ports 114A/B may be arranged within a length encompassed by the stroke length 132 and the piston length 134 such that a portion of the piston 116 may encroach or pass in front of the port 114A/B when it is in its fully retracted or fully extended position.

The piston 116 may be arranged within the cylinder housing 112 and may be configured to articulate within the cylinder chamber 120 and along the length of the chamber 120 based on pressures developed in the fluid on one or more sides of the piston 116. That is, for example, where a dual acting cylinder is provided, fluid may be present on both sides of the piston 116 and pressure may be increased on one side of the piston 116 and reduced on the other side of the piston by hydraulic pumps. The differences in pressure may urge the piston 116 one direction or another causing the piston 116 to translate. The piston 116 may drive the rod 118 allowing the cylinder 110 to perform work.

The rod 118 may be rigidly secured to the piston 116 and may move with the piston 116 as the piston translates through the cylinder chamber 120. The rod may extend from the piston 116, through the cylinder chamber 120, and out the extension end 124 of the cylinder housing 112. A seal 136 (see FIG. 3) may be provided where the rod 118 extends through the cylinder housing 112 to maintain fluid pressure within the chamber 120 as the rod 118 extends and/or retracts out of and into the chamber 120. The rod 118 may have a lug 138 arranged on an end opposite the piston 116 and outside the cylinder housing 112 as shown in FIGS. 2 and 3. The lug 138 may have a round bore through the lug for receiving a bolt, pin, or other pivot providing connector.

Figure 5:
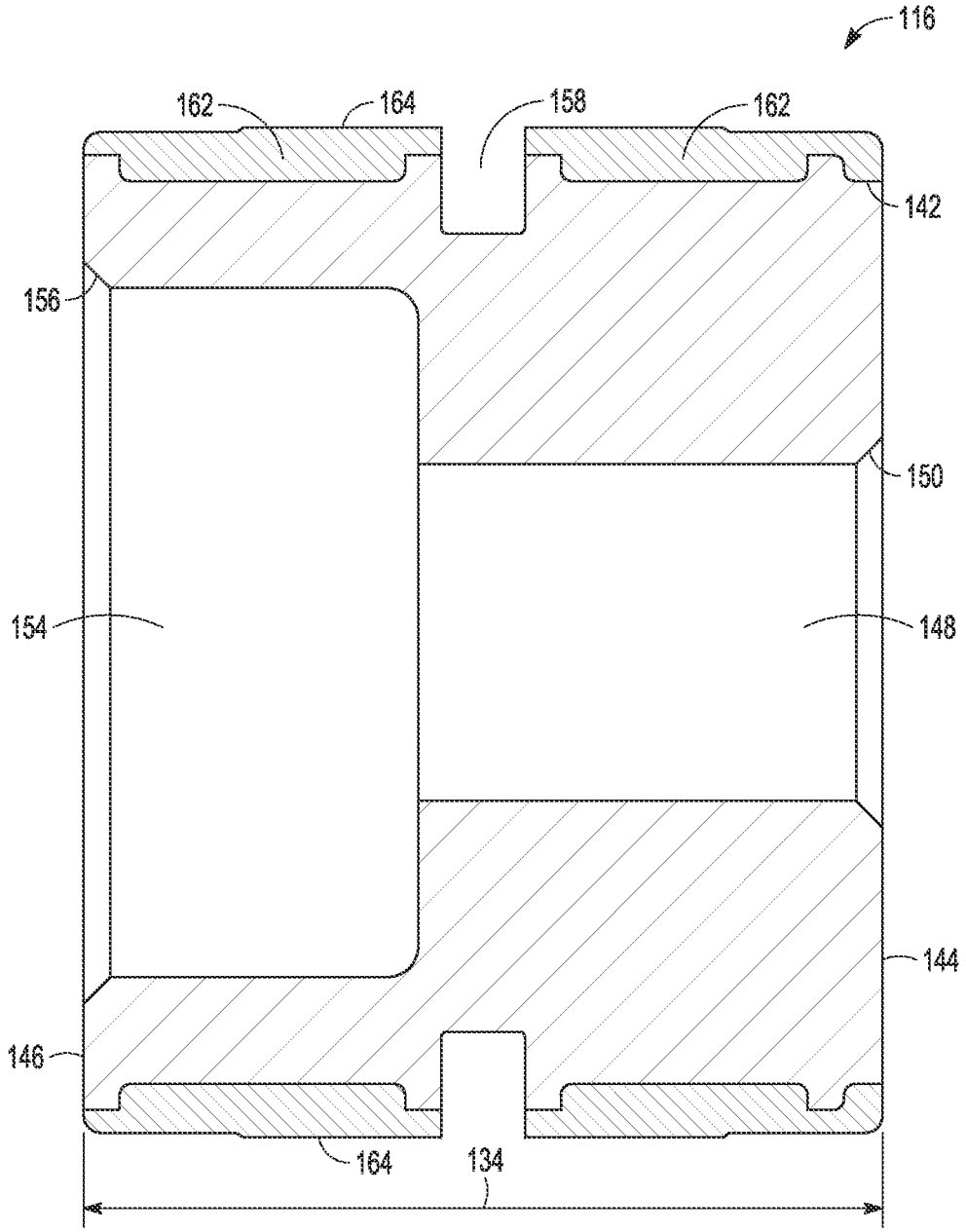
FIG. 5 is a cross-sectional view of the integrated piston and bearing of the hydraulic cylinder of FIG. 3, according to one or more embodiments.
Figure 6:
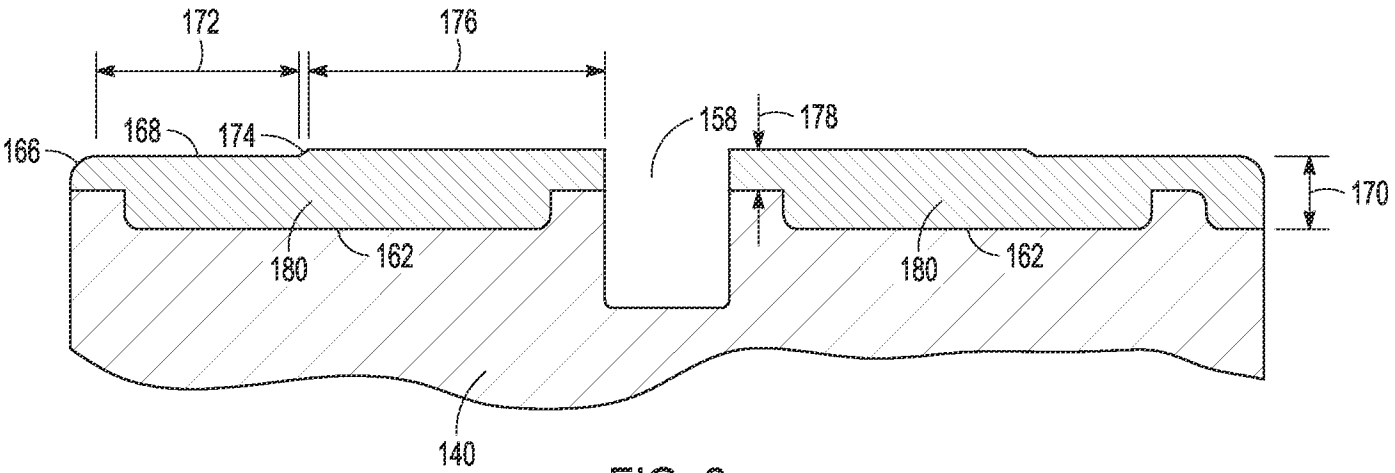
FIG. 6 is a close-up partial cross-sectional view of the integrated piston and bearing of FIG. 5, according to one or more embodiments.

Turning now to FIGS. 5 and 6, the piston 116 of the present disclosure may be described in greater detail. As shown, the piston 116 may be shaped to match the cross-sectional shape of the cylinder chamber 120 and may be configured to sealingly and slidably engage an interior surface of the chamber 120. The piston 116 may also be configured for securing to the piston rod 118. As shown, the piston 116 may be substantially cylindrically shaped and may form a sort of plug for arrangement in the cylinder chamber 120. The piston 116 may include a body portion 140 having an outer and substantially cylindrical surface 142. The body portion 140 may have a rod extension side 144 and a rod connecting side 146. That is, the rod extension side 144 may be the side of the piston 116 that the rod 118 extends away from and the rod connecting side 146 may be the side that the rod 118 is fastened to the piston. The piston body portion 140 may also include a bore 148 extending through the length of the piston 116 for insertion and securing of the rod 118. As shown, the bore 148 may extend through the full length of the piston 116 from the rod connecting side 146 to the rod extension side 144. At the rod extension side 144, the bore may include a peripheral chamfer 150 for seating of a corresponding chamfer on the rod 118. That is, the rod 118 may have a diameter along a large majority of its length, but at the piston 116, the rod may have a necked down or smaller diameter. The rod may have a chamfered edge 152 between the larger diameter and the smaller diameter and the chamfered edge on the rod 118 may seat against the peripheral chamfered edge 150 of the bore 148. At the rod connecting side 146 of the piston bore 148, a relatively large counterbore 154 may be provided to provide for recessing a rod nut within the surface of the piston 116. The counterbore 154 may have a diameter substantially larger than the bore 138 providing for seating of the rod nut within the bore 138. Like the extension side 144, the counterbore 154 may include a peripheral chamfer 156 at an outer edge creating a smooth transition between the rod connecting end 146 and the counter bore 154.

On an outer surface of the piston 116, the piston may include a peripherally extending seal groove 158. The groove 158 may be arranged at approximately the mid-length of the piston measured in the actuation or stroke direction of the piston 116. The groove 158 may be adapted to receive a seal. That is, as shown, for example in FIG. 4, a resilient seal 160 may be provided in the groove 158. In one or more embodiments, the seal 160 may be annularly shaped with an inner diameter for seating against the base of the groove and an outer diameter slightly larger than the piston and adapted to resiliently engage the inner surface of the cylinder chamber as shown. The seal 160 may have a width measured along the length of the piston 116 and may be selected to frictionally engage the sidewalls of the groove or nest in the groove.

In addition to the seal groove 158, the piston may include one or more peripherally extending bearing recesses 162. The bearing recesses 162 may be arranged outboard of the seal groove 158 and on a fluid engaging side of the groove 158. In one or more embodiments, as shown, the piston 116 may include a pair of bearing recesses 162; one on each side of the seal groove 158. The bearing recesses 162 may have a width measured along the length of the piston and/or in the stroke direction of the piston and a depth measured in a radial direction of the piston. In one or more embodiments, the width may be substantially larger than the depth and may for example be approximately 2, 3, 4, 5, or 6 times as wide as it is deep. In other embodiments, other shape profiles of the bearing recess may be provided. The bearing recesses 162 may be adapted for receiving ribs on an inside of a bearing. For example, a bearing 164 may be molded over the piston 116 and material may flow into the bearing recess 162 during the over molding process. The recesses and the ribs may function to secure the bearing 164 to the piston 116 and prevent longitudinal motion of the bearing 164 relative to the piston 116.

Turning now to the bearing 164, reference may be made to FIG. 6, which is a close-up partial cross-sectional view of the integrated piston 116 and bearing 164. As shown, the bearing 164 may overlay the outer peripheral surface 142 of the piston 116. In one or more embodiments, the bearing 164 may be provided on either side of the sealing groove 158. One of the portions of the bearing 164 on one side of the sealing groove 158 will be described herein and the portion of the bearing 164 on each side of the sealing groove 158 may be mirror images of one another. In one or more embodiments, while the portions on either side of the groove may be similar, they may have different lengths, positions, or geometries based on differences in the respective port positions, types, features, or other considerations.

As shown in cross-section in FIG. 6, the bearing 164 may extend from an end of the piston, along the surface of the piston, and up to the sealing groove. The bearing may begin at the end of the piston with a bullnose edge 166. In one or more other embodiments, the piston may have a chamfered edge and the bearing may begin with a peripherally extending chamfered edge that is aligned with a peripherally extending chamfered edge on the piston 116. Following the outer surface of the bearing 164 from the bullnose 166, the bearing may have a substantially flat surface 168 when viewed in cross section that extends from the bullnose 166 and along the outer wall of the piston defining a first or primary thickness 170 in a setback region 172 of the bearing. In one or more embodiments, the primary thickness 170 may be slightly thinner than the depth of the bearing recesses 162. In other embodiments, the primary thickness 170 may be the same as the bearing recess depth or thicker than the bearing recess depth may be provided. In one or more embodiments, the primary thickness may range from approximately 0.5 mm to approximately 15 mm or from approximately 1 mm to approximately 10 mm or a thickness of approximately 5 mm may be used.

Continuing along the bearing surface, the bearing may include a snubbing feature. In one or more embodiments, the snubbing feature may include a snubbing chamfer 174. That is, the surface diameter may increase at a point along the length of the bearing and the transition between the narrower diameter in the setback region 172 and the wider diameter in the full region 176 may be provided by a snubbing chamfer 174. The snubbing chamfer 174 may be a peripherally extending chamfer that transition between the two diameters. As shown, the chamfer may have an angle relative to the longitudinal or stroke direction of the piston ranging from approximately 5 degrees to approximately 60 degrees, or from approximately 15 degrees to approximately 45 degrees, or a chamfer angle of approximately 30 degrees may be provided. The snubbing chamfer may have a length measured along the length of the piston which may be dependent on the relative thicknesses of the adjacent regions and the chamfer angle. The snubbing chamfer may be positioned approximately 3 mm to approximately 50 mm from the bottom of the piston or approximately 6 mm to approximately 24 mm, or a position of approximately 12 mm may be used. Other positions of the snubbing chamfer may be provided and may be adjusted based on the size of the cylinder and piston, for example and the relationship of the piston position and the related ports. It is to be appreciated that while a snubbing chamfer has been shown, alternative approaches to snubbing or cushioning may include other snubbing features such as straight slits, grooves, or a scroll design, for example. In one or more embodiments a taper may be provided over a longer length than the snubbing chamfer shown. Still other alternatives to a snubbing feature may be provided.

Beyond the snubbing chamfer, the bearing may have a full thickness 178 between the outer surface of the bearing and the peripheral surface of the piston. The full thickness 178 of the bearing 164 in this full region 176 of the bearing 164 may range from approximately 0.5 mm to approximately 15 mm, or from approximately 1 mm to approximately 10 mm, or a thickness of approximately 7 mm may be provided. This full thickness 178 may be selected based on the piston diameter and the cylinder chamber diameter such that the full thickness of the bearing and the diameter of the piston very closely approach the full diameter of the cylinder chamber. The full region 178 of the bearing may extend from the snubbing chamfer 174 to the sealing groove 158 and may terminate at the sealing groove.

The inside surface of the bearing 164 may follow the outer contour of the piston 116. In one or more embodiments, the bearing 164 may be over molded on the piston 116 and as such, the inner surface of the bearing may conform to the outer surface of the piston. As shown, the inner surface of the bearing may follow the outer surface piston from the end of the bearing up to the bearing recess 162. Upon reaching the bearing recess 162 the inner surface of the bearing 164 may return inward into the bearing recess forming an internal bearing rib 180 on the inside surface of the bearing 164. The internal bearing rib 180 may engage the piston in registered fashion with the bearing recess 162. Between the bearing recess 162 and the sealing groove 158, the inner surface of the bearing 164 may follow the outer surface of the piston 116.

While the bearing portions on either side of the sealing groove have been said to be mirror images of one another, one or both of the ends of the bearing may include a return as shown. That is, for example, the bearing may return across the end of the piston 116, where the bearing begins. Such a return may be provided at the top of the piston as shown, at the bottom of the piston, or at both the top of the piston and the bottom of the piston. Still other types and shapes of beginning edges of the bearing may be provided.

In one or more embodiments, the piston may be a 2 part element that is split down its center in the form of 2 halves. In one or more embodiments, the piston may be assembled and the bearing may be over molded over the piston thereby covering the seam formed between the 2 halves of the piston. This may be beneficial for purposes of the particular cushioning envisioned here where portions of the piston may travel across the ports of the cylinder.

INDUSTRIAL APPLICABILITY

In operation and use, the present integrated piston and bearing may provide for snubbing or cushioning of the piston stroke without adding length to the hydraulic cylinder 110. That is, as mentioned, the ports 114A/B may be arranged within a length encompassed by the stroke 132 of the piston and a length of the piston 134. As such, as the piston 116 travels toward each end of its stroke 132, a portion of the piston 116 may pass in front of the respective port 114A or 114B at that end, which may provide a cushioning effect. As shown in close up detail in FIG. 7, a large portion of the setback region 172 of the bearing has passed by the port 114A leaving only a small portion of the setback region 172 in front of the port 114A. The majority of the port 114A may be covered by the full region 176 of the bearing 164.

The method of operation 200 may include actuating a hydraulic system to extend or retract the hydraulic cylinder (202). As may be appreciated, as the piston 116 propagates along the cylinder chamber 120 toward the port 114A/B, the port 114A/B may be fully open and no restrictions on exiting fluid may be present. However, as the piston 116 begins to encroach on the port 114A/B, the setback region 172 of the bearing 164 may pass in front of the port 114A/B. As such, the method may include restricting the flow rate of hydraulic fluid out of the port by limiting the pathway to/from the port (204). Moreover, such limiting of the fluid pathway to/from the port may be provided by a bearing profile having a setback region 172. The method may also include further actuation of the hydraulic system to continue extending or retracting the hydraulic cylinder (206). As the snubbing chamfer reaches the port, further restriction on the fluid flow may occur. That is, the method may include gradually transitioning from restricting the fluid flow to/from the port to restricting the area of the port (208). That is, the snubbing chamfer on the seal may make a gradual transition based on the chamfer angle between restricting the pathway to/from the port to actually obstructing the available area of the port. The method may also include further actuation of the hydraulic system to continue extending or retracting the hydraulic cylinder (210). As the full region of the bearing reaches the port, further restriction on the fluid flow may occur. That is, the method may include gradually obstructing a larger area of the port (212). This may be provided by advancing the full region of the bearing across the port opening thereby decreasing the available area of the port for fluid to flow.

Figure 7:
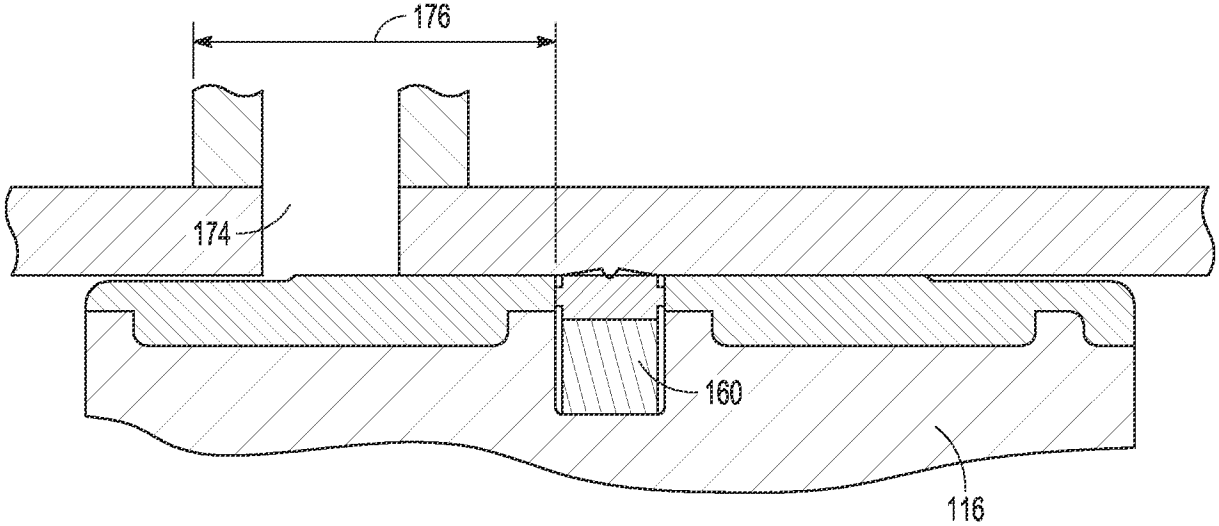
FIG. 7 is a close-up partial cross-sectional view of the lower port portion of FIG. 4, according to one or more embodiments.
Figure 8:
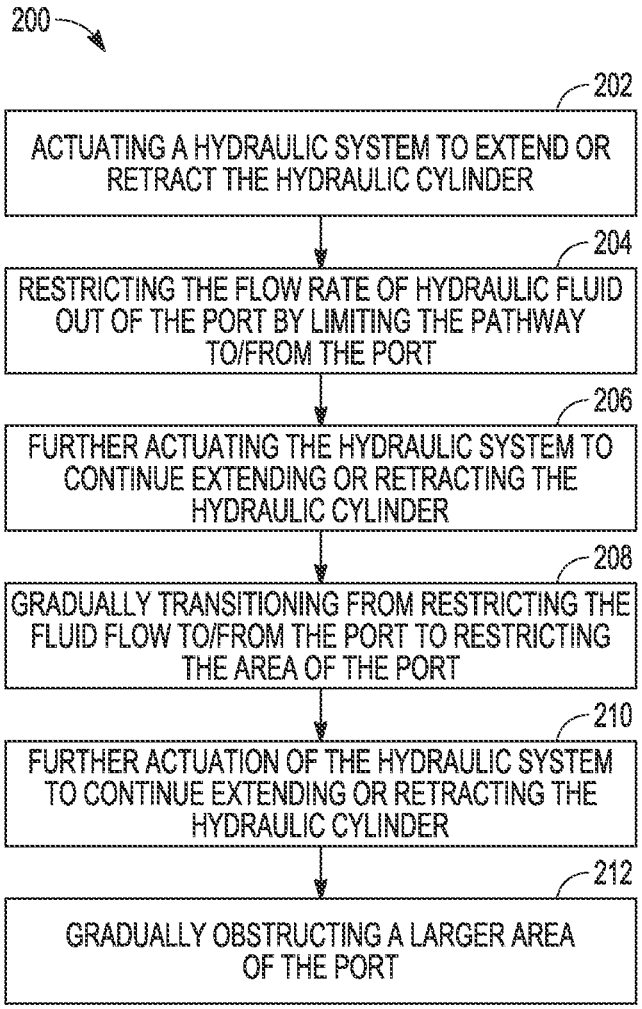
FIG. 8 is a flow diagram showing a method of operation, according to one or more embodiments.

As shown in FIG. 7, the fully retracted position of the piston 116 may occur where the full region 176 of the bearing 164 substantially covers the port 114A/B but leaves a small portion of the port 114A/B open for fluid flow. For example, the stroke of the piston and the relative position of the ports 114A/B to the ends of the stroke may be such that the full region covers a selected portion of the respective port depending on the cushioning effect desired. For example, in one or more embodiments, the full region may cover a percentage of the area of the port. The percentage of cover may range from approximately 0% to approximately 99%, or from approximately 50% to approximately 90%, or from approximately 75% to approximately 85%, or the percentage of cover may be approximately 80%.

This process of gradually restricting the fluid flow out of the port using the bearing with the described surface contour may provide a cushioning effect as the piston returns to its fully retracted position. The same may occur as the bearing approaches its fully extended position because the bearing on the opposite side of the seal may interact with the port at the other end of the housing in the same manner.

The above detailed description is intended to be illustrative, and not restrictive. The scope of the disclosure should, therefore, be determined with references to the appended claims, along with the full scope of equivalents to which such claims are entitled.

What is claimed is:

1. An integrated piston and bearing, comprising:

a piston having an outer peripheral surface and a first end and a second end;

a bearing arranged on the outer peripheral surface and having a surface contour including a setback region with a first thickness and a full region with a second thickness, thicker than the first thickness, and a snubbing chamfer transitioning between the first and second thicknesses, wherein the setback region comprises a first edge substantially aligned with the first end of the piston and a surface that extends generally away from the first edge, along the outer wall of the piston, and to the snubbing chamfer arranged at a point along the length of the bearing.

2. The integrated piston and bearing of claim 1, wherein the piston comprises a sealing groove arranged between the first end and the second end and configured for receiving a seal.

3. The integrated piston and bearing of claim 2, wherein the bearing extends from the first end to the sealing groove.

4. The integrated piston and bearing of claim 3, wherein the setback region extends from the first end to the snubbing chamfer and the full region extends from the snubbing chamfer to the sealing groove.

5. The integrated piston and bearing of claim 3, further comprising another bearing portion extending from the second end to the sealing groove.

6. The integrated piston and bearing of claim 5, wherein the another bearing portion comprises another setback region extending from the second end to another snubbing chamfer and another full region extending from the another snubbing chamfer to the sealing groove.

7. The integrated piston and bearing of claim 1, wherein the snubbing chamfer has an angle relative to a stroke direction of the piston ranging from approximately 5 to approximately 60 degrees.

8. The integrated piston and bearing of claim 7, wherein the angle is approximately 30 degrees.

9. A hydraulic cylinder, comprising:

a cylinder housing;

an integrated piston and bearing arranged within the housing, the integrated piston and bearing having a length, a stroke length defined by the housing, and an outer surface contour including a snubbing feature;

a piston rod extending from the integrated piston and bearing and out an end of the cylinder housing; and a port arranged on the housing within a region defined by the length of the integrated piston and bearing and the stroke length such that a portion of the integrated piston and bearing passes by the port when the integrated piston and bearing is at an end of the stroke length, wherein the integrated piston and bearing comprises:

a piston having an outer peripheral surface and a first end and a second end; and a bearing arranged on the outer peripheral surface and having a surface contour including a setback region with a first thickness and a full region with a second thickness, thicker than the first thickness, and the snubbing feature transitions between the first and second thicknesses, wherein the setback region comprises a first edge substantially aligned with the first end of the piston and a surface that extends generally away from the first edge, along the outer wall of the piston, and to the snubbing feature arranged at a point along the length of the bearing.

10. The hydraulic cylinder of claim 9, wherein the integrated piston and bearing comprises a sealing groove between the first end and the second end, the sealing groove configured for receiving a seal.

11. The hydraulic cylinder of claim 10, wherein the bearing extends from the first end to the sealing groove.

12. The hydraulic cylinder of claim 10, wherein the bearing comprises two portions including a first portion extending from the first end to the sealing groove and a second portion extending from the second end to the sealing groove, wherein the first portion and the second portion each comprise a snubbing feature.

13. The hydraulic cylinder of claim 12, further comprising another port arranged at an opposite end of the cylinder housing as the port and within the region such that a portion of the integrated piston and bearing passes by the port or the anther port when the integrated piston and bearing is at an end of the stroke length.

14. The hydraulic cylinder of claim 9, wherein the snubbing feature comprises a snubbing chamfer having an angle relative to a stroke direction of the integrated piston and bearing ranging from approximately 5 to approximately 60 degrees.

15. The hydraulic cylinder of claim 14, wherein the angle is approximately 30 degrees.

16. A work machine comprising:

a body supported by a ground engaging transport mechanism; and a hydraulically driven tool comprising a hydraulic cylinder, the hydraulic cylinder comprising:

a cylinder housing;

an integrated piston and bearing arranged within the housing, the integrated piston and bearing having a length, a stroke length defined by the housing, and an outer surface contour including a snubbing feature;

a piston rod extending from the integrated piston and bearing and out an end of the cylinder housing; and a port arranged on the housing within a region defined by the length of the integrated piston and bearing and the stroke length such that a portion of the integrated piston and bearing passes by the port when the integrated piston and bearing is at an end of the stroke length, wherein the integrated piston and bearing comprises:

a piston having an outer peripheral surface and a first end and a second end; and a bearing arranged on the outer peripheral surface and having a surface contour including a setback region with a first thickness and a full region with a second thickness, thicker than the first thickness, and the snubbing feature transitions between the first and second thicknesses, wherein the setback region comprises a first edge substantially aligned with the first end of the piston and a surface that extends generally away from the first edge, along the outer wall of the piston, and to the snubbing feature arranged at a point along the length of the bearing.

17. The work machine of claim 16, wherein the work machine is a skid steer loader.

18. The work machine of claim 17, wherein the hydraulically driven tool is a bucket and the hydraulic cylinder is arranged and configured for tipping the bucket.

* * * * *